US005501604A

United States Patent [19]

Roopnarine et al.

[11] Patent Number: 5,501,604

[45] Date of Patent: Mar. 26, 1996

[54] FLEXIBLE BAND-GEARS FOR CONDUCTING POWER/SIGNAL ACROSS ROTARY JOINT

[75] Inventors: Roopnarine, New York, N.Y.; Thomas Myrick, New Providence, N.J.; Kin Y. Kong, Baldwin, N.Y.

[73] Assignee: Honeybee Robotics, Inc., New York, N.Y.

[21] Appl. No.: 200,753

[22] Filed: Feb. 23, 1994

[51] Int. Cl.[6] ..... H01R 39/08

[52] U.S. Cl. ..... 439/19; 439/23

[58] Field of Search ..... 439/13, 24, 23, 439/18–21, 15, 28; 475/331

[56] References Cited

FOREIGN PATENT DOCUMENTS 796964 1/1981 U.S.S.R. ..... 439/13

OTHER PUBLICATIONS

Honeywell Test Specifications for Gimbal Roll Ring 1553, dated Aug. 6, 1992, pp. 1–4, and the drawings JB–4 to PJ–11.

*Primary Examiner*—Gary F. Paumen

*Attorney, Agent, or Firm*—Ostrager, Chong & Flaherty

[57] ABSTRACT

A flexible band-gear system has an ring gear assembly with bands in electrical contact with and a ring gear in mechanical engagement with corresponding bands and gears of planet gear assemblies which are in turn in electrical contact and geared engagement with a sun gear assembly mounted to a rotating shaft. Electrical power and/or an electrical signal can thus be conducted across a rotating joint which also transfers mechanical power. The flexible band-gear system can also be used in linear applications to transfer electrical power/signal via rolling contact with a linear band. The geared aspect of the system simplifies axial alignment and maintains the relative positions (within the ring annulus) of the planet gears. Electrical power and signal capacity can be varied with the number of planet gears in the system. Multiple channels are added using segmented contact bands and/or multiple contact band layers.

20 Claims, 9 Drawing Sheets

FLEXIBLE BAND-GEARS FOR CONDUCTING POWER/SIGNAL ACROSS ROTARY JOINT

FIELD OF THE INVENTION

The field of the invention is mechatronics. The invention is applicable in electrical power transmission, electrical signal transmission, and mechanical power transmission.

The invention is directed to a flexible band-gear system having bands for transmitting electric power or an electrical signal across a rotary joint, and particularly to a system having bands provided with ring, planet and swan gears.

BACKGROUND ART

In the prior art, slip rings, roll rings, mercury contact assemblies, and other devices have been used to transmit electrical power or data signals across a rotating mechanical interface. Related technology includes brushes in many types of motors and torque sensors.

Slip rings, which use ring and brush contact to transmit electricity across a rotating interface, have problems in that they wear quickly (due to sliding friction of brushes), carry only one channel per layer of brushes, can be electrically noisy, induce too much torque resistance, and generate particle debris through wear. Debris is not a desirable quality for many clean room and aerospace applications. Slip rings are also difficult to align and relatively costly, and have no use in the transfer of mechanical power.

Roll rings have limitations in that only one ring can be used per layer of assembly for signal transfer. Roll rings also present alignment difficulties in assembly and do not possess suitable mechanical power transmission potential. Mercury contact assemblies are not compact, possess no mechanical power transfer potential, can be costly, and are associated with hazardous material (outgassing of mercury vapor).

SUMMARY OF THE INVENTION

The present invention provides a flexible band-gear system comprising a ring gear assembly having bands in electrical contact with and a ring gear in mechanical engagement with corresponding bands and planet gears, respectively, of a plurality of planet gear assemblies, which are, in turn, in electrical contact and geared engagement with bands and a sun gear of a sun gear assembly mounted to a rotary shaft. Electrical power and/or an electrical signal can thus be transmitted across a rotary joint which also transfers mechanical power. The flexible band-gear system can also be used in linear applications to transfer electrical power/signal while in rolling contact with a linear band.

The geared aspect of the system simplifies axial alignment and maintains mechanical stability in the relative positions (within the annulus) of the planet gears. Electrical power and signal capacity can be varied with the number of planet gear assemblies in the system. Multiple channels can be added using segmented bands and/or multiple band layers.

Other objects, features and advantages of the present invention will be apparent from the following detailed description of the preferred embodiments with reference to the drawings, of which:

BRIEF DESCRIPTION OF THE DRAWINGS

FIG. 13 is an exploded view in cross-section of the sun gear assembly of the flexible band-gear assembly.

DETAILED DESCRIPTION OF THE INVENTION

In the present invention, the flexible band-gear system is an electromechanical device which transmits electrical power and/or signal through an integral planetary system of gears and rolling contact surfaces (bands). This arrangement of gears and bands allows for development of a wide range of simplified cableless joints, that is, the transmission of electric power/signal without wires across a partially or continuously rotating joint.

Figure 1B:
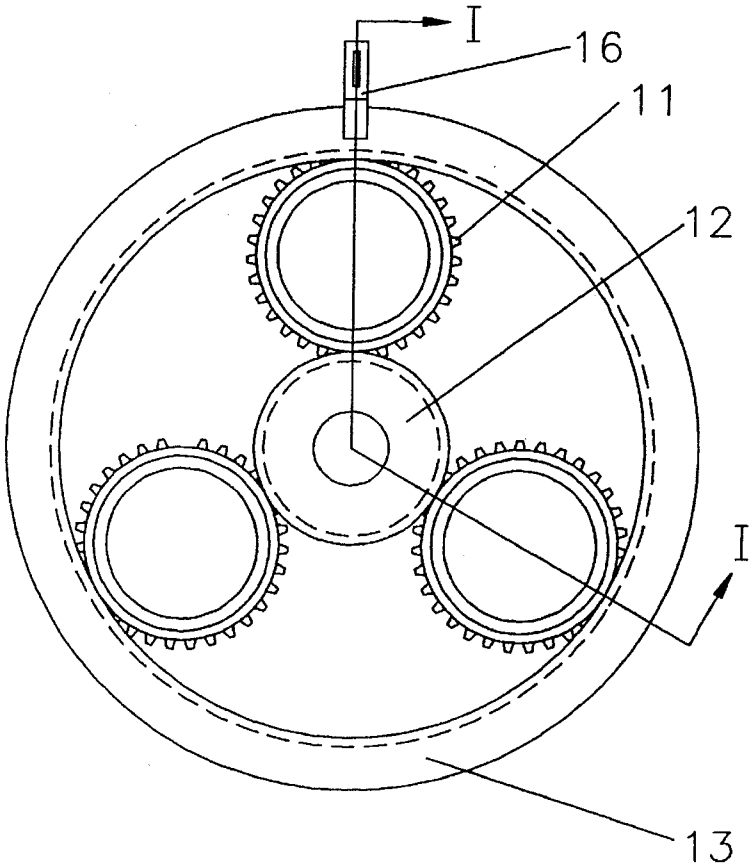
FIG. 1A is a schematic view in cross-section of a flexible band-gear assembly in accordance with the invention taken along view line A—A of the end view thereof shown in FIG. 1B.
Figure 1A:
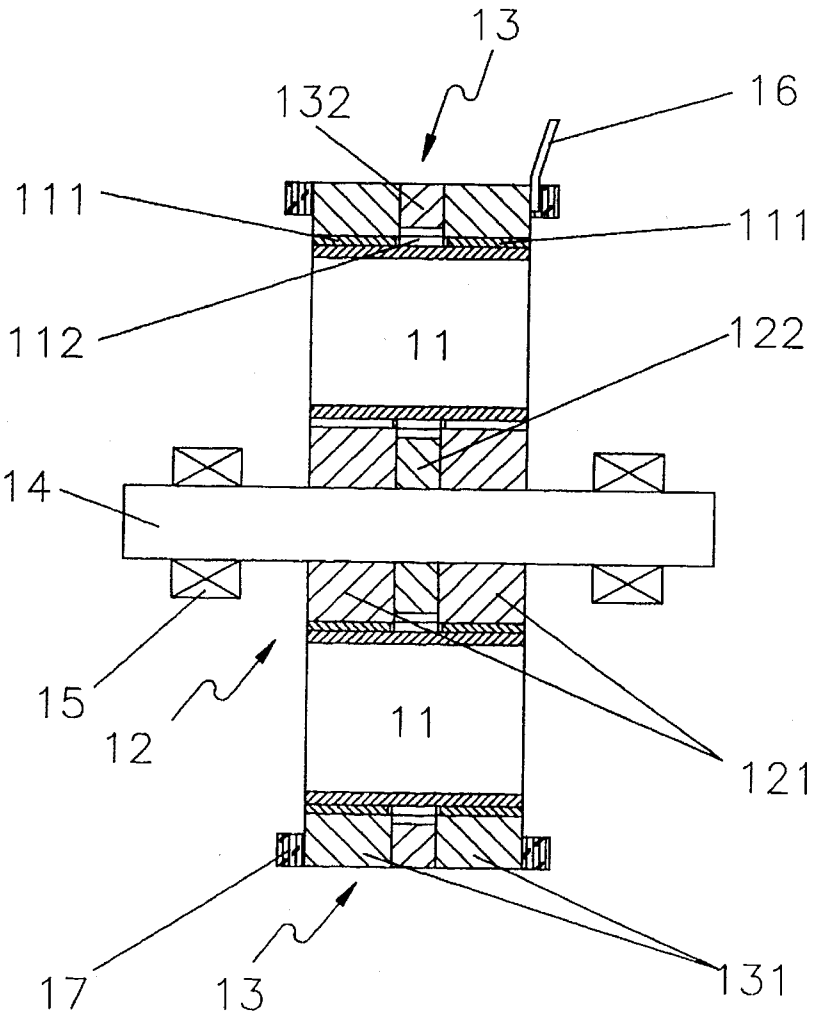

In FIGS. 1A and 1B, a main embodiment of the flexible band-gear system is shown having a plurality of planet gear assemblies 11 interposed between a ring gear assembly 13 and a sun gear assembly 12 mounted to a rotatable shaft 14. The band-gears are made from highly conductive, highly wear resistant materials with two distinct sections, i.e., a toothed gear and a non-toothed band. The ring gear assembly 13 has a toothed gear 132 and bands 131. The planet gear assemblies 11 each have a toothed gear 112 and bands 111. The sun gear assembly 12 has a toothed gear 122 and bands 121. The bands and toothed gears of the band-gears are mechanically integral, but may be electrically isolated from each other through the use of insulative spacers or the like in order to eliminate noise due to electrical transmission across the moving gear teeth.

Figure 2B:
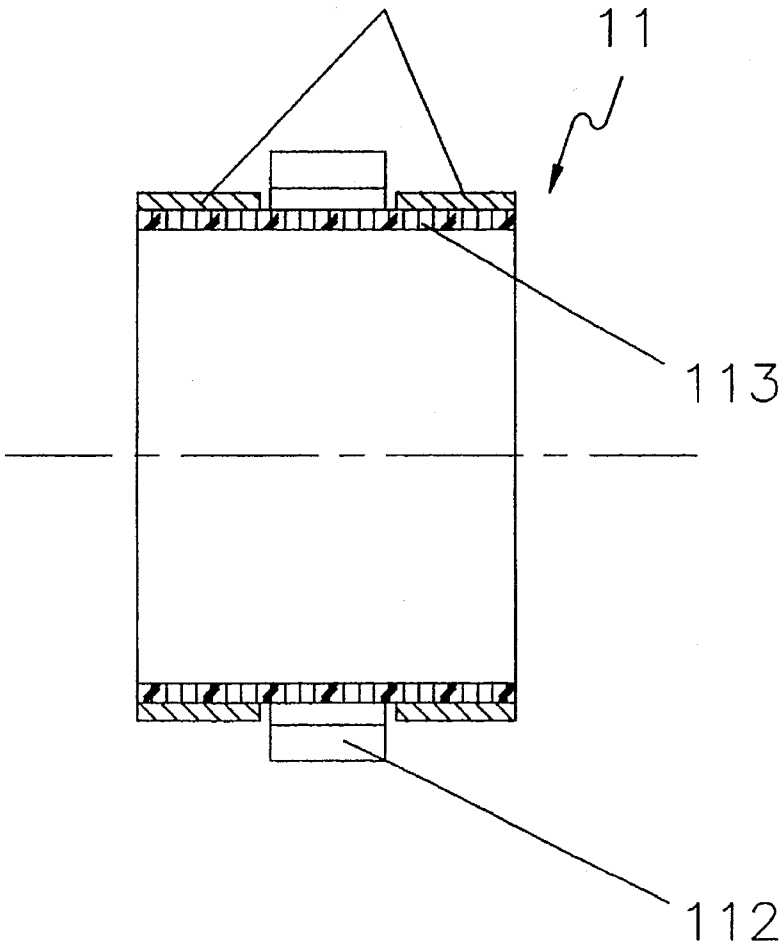
FIG. 2B is a cross-sectional view of the planet gear assembly taken along view line A—A of FIG. 2A.
Figure 2A:
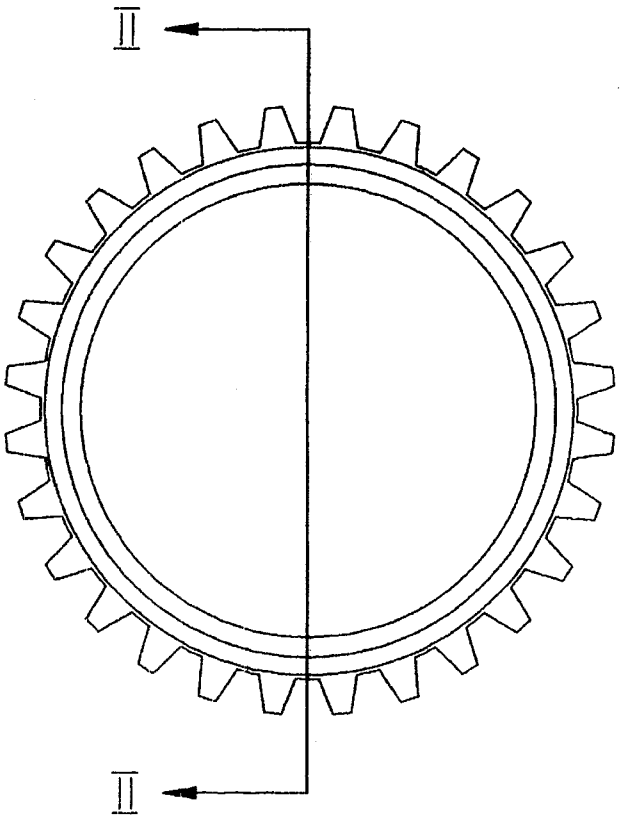
FIG. 2A is an end view of a planet gear of the flexible band-gear assembly.

The planet gear assembly 11 is shown in greater detail in FIGS. 2A and 2B. The bands 111 on the planet gear assembly are formed on a core 113 of non-conductive material and have a suitable thickness and degree of elasticity to ensure that electrical contact is always maintained with the sun and ring bands 121 and 131, respectively. The uniformity of electrical contact is assured by preloading the bands of the planet gear assemblies against the sun and ring bands. In so doing, the bands on the planet gear assemblies deform to provide greater area contact. The planet gear assemblies 11 are maintained in their relative positions by the toothed gears 112 as they rotate about their centers and revolve around the sun gear assembly 12. The toothed gears 112 are formed as standard spur gears and are in mesh with similar gear tooth profiles 122 and 132 ion the sun and ring gear assemblies, respectively. As the planet gear assemblies 11 revolve around the sun gear assembly 12, some amount of micro slipping takes place between their bands and the bands of the ring and sun gear assemblies. The extent to which micro slipping takes place can be controlled by adjusting the relative diameters of the planet, ring and sun gear bands.

Figure 3:
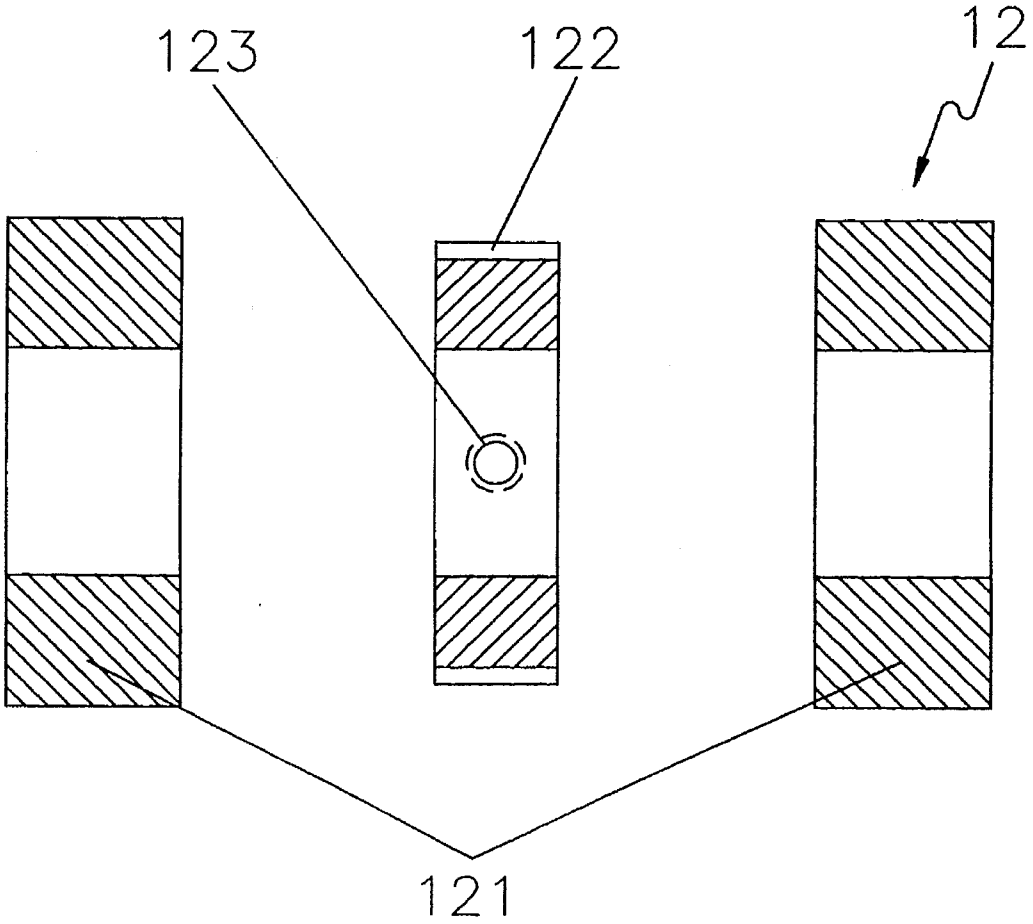

Referring to FIG. 3, the sun gear assembly 12 has bands 121 on two sides made of highly conductive, highly wear resistant material, and a central geared section 122 formed as a standard spur gear which is mounted on the shaft 14 with a set screw 123 equivalent) that prevents relative rotation with the shaft. The bands 121 of the sun gear assembly are preloaded in rolling contact with the bands 111 of the planet gear assemblies and provide the main path for electrical power/signal transfer, while the geared surfaces transmit mechanical power between the gears and maintain the positional alignment of the planet gear assemblies. In the configuration shown, the shaft 14 acts as a mechanical input for driven rotary motion or continuous driven rotation of the system. The shaft is mounted at either end on radial bearings 15 (see FIG. 1A). Electrical signal/power is transferred across the sun gear assembly and shaft to/from an electronic receiver or input device. The toothed gears 112, 122 and 132 may also be used to transfer unregulated electrical power across the rotating joint through the shaft separated from electrical signals which can be transferred via conductive layers electrically insulated on the surface of the shaft.

Figure 4:
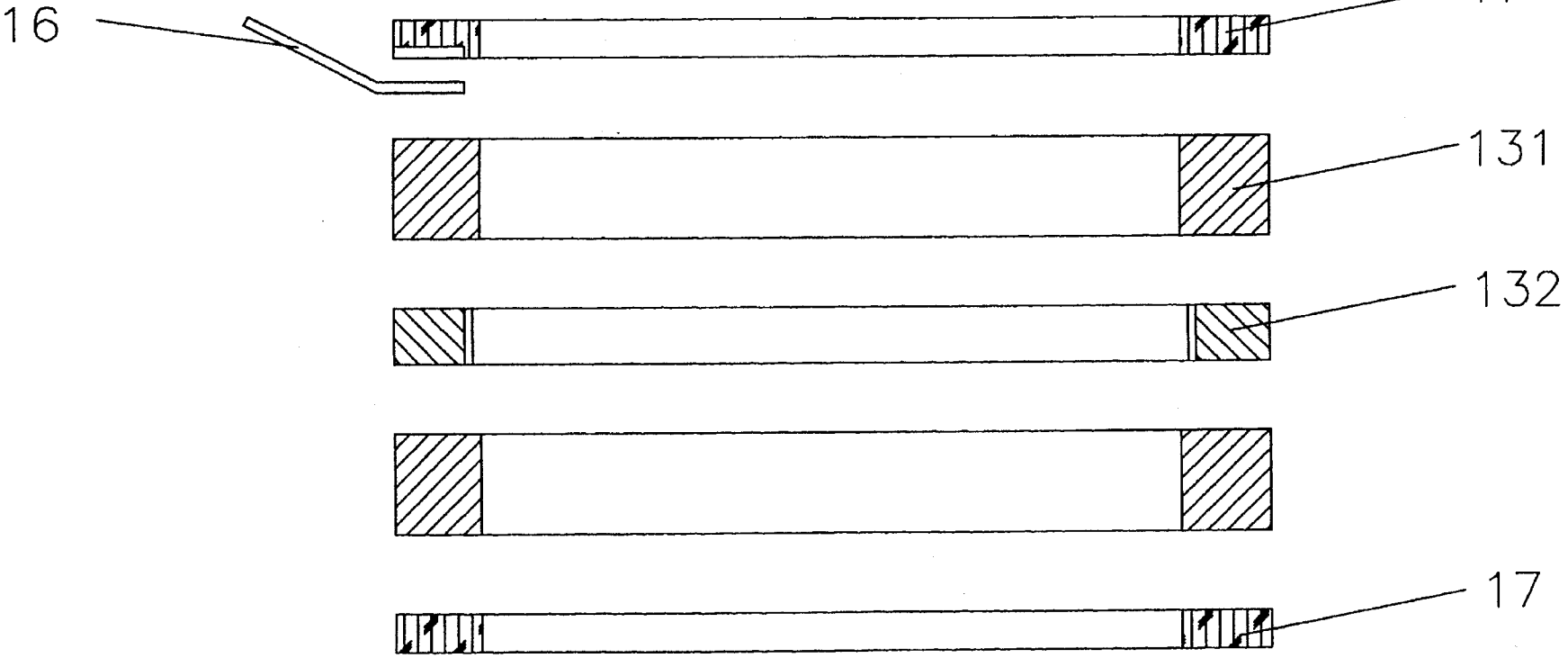
FIG. 4 is an exploded view in cross-section of a ring gear assembly of the flexible band-gear assembly.

As shown in FIG. 4 of the main embodiment, the ring gear assembly 13 consists of an annular geared ring 132 centrally located between two bands 131 made of highly conductive, highly wear resistant material. The inner surfaces of the bands 131 are used to transfer electrical power/signal across the planet-ring gear boundary. The ring gear 132 allows mechanical motion to be transmitted between the planetary system of gears and the ring gear assembly while maintaining the relative positions of the planet gear assemblies. The ring gear assembly also includes an input or output terminal 16 for the electrical power/signal, and may be electrically insulated at its outer surfaces with non-conductive layers 17 made of insulative material. The arrangement as shown in FIG. 4 allows a single channel of electrical current/signal to pass across the ring, planet, and sun gear assemblies and the shaft. As stated before, unregulated power may also be transmitted across the rotary joint via the toothed gears in an arrangement where the gears are electrically insulated from the bands with insulative spacers or the like.

Each flexible band of the planet gear assemblies transfers electrical current/signal across the ring-planet-sun geared/bandg interface. With a plurality of planet gear assemblies contained within the ring gear annulus, the flexible band-gear assembly is capable of transmitting multiple amperes of current across the geared/band system. The current carrying capacity can be varied by changing the size of the preload on the bands, the width and thickness of the bands, and the number of planet gear assemblies in the system. Current is transferred across the planet gear assemblies via rolling contact between the planet-ring and planet-sun band interfaces. As the shaft is rotated (coupled to a rotary device), the planet gears, which mesh with the sun gear, revolve about the central sun gear assembly and also rotate about the center axes of the individual planet gear assemblies. The arrangement of bands and geared surfaces of the sun, planet, and ring gear assemblies provide for easy initial alignment and uniform contact areas for current/signal transmission and also allow the system to maintain axial alignment at any speed of the shaft.

Figure 5:
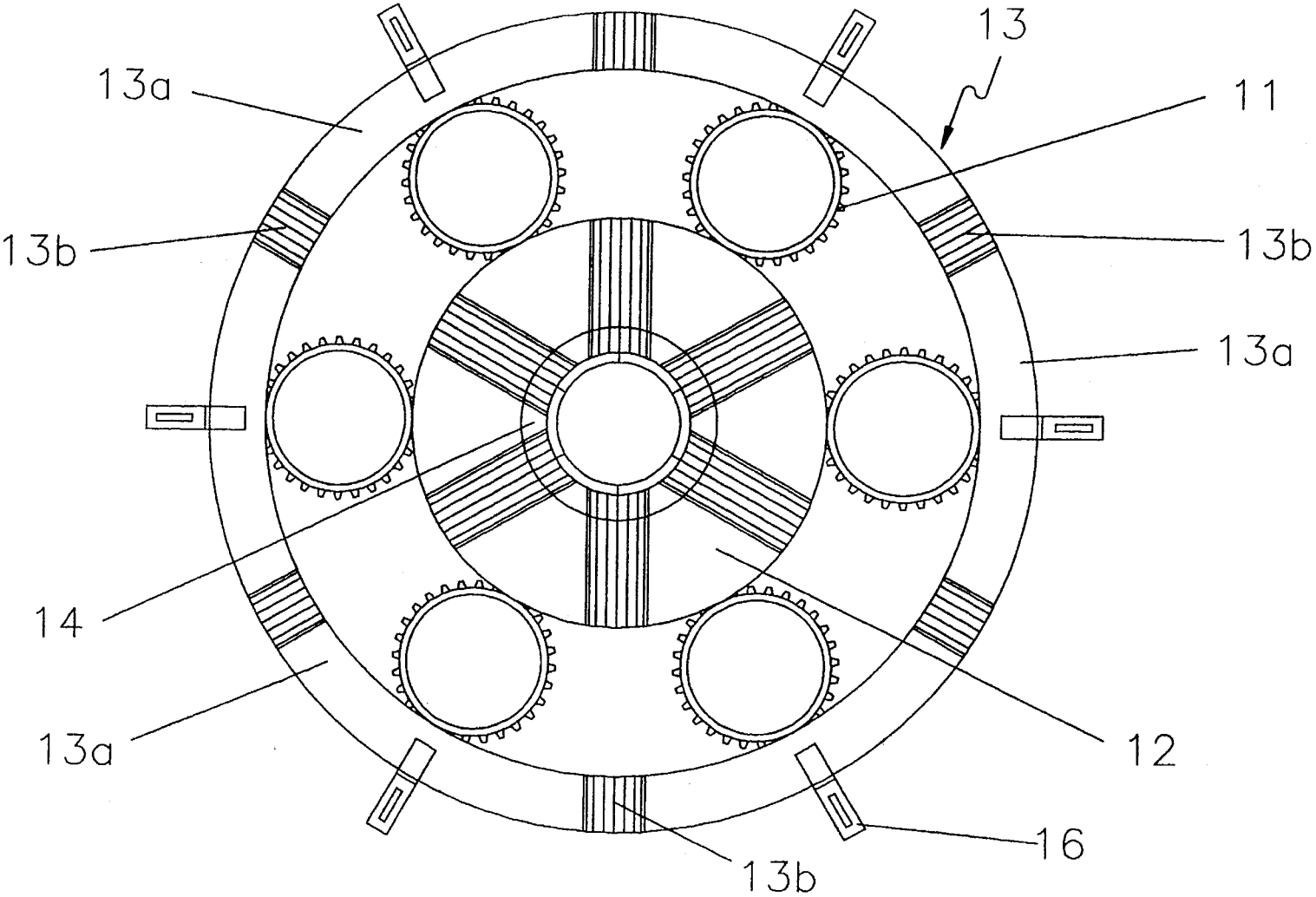
FIG. 5 illustrates an alternate embodiment of a flexible band-gear assembly having multiple channel capability provided through segmented ring and sun gear assemblies and a segmented shaft.
Figure 6:
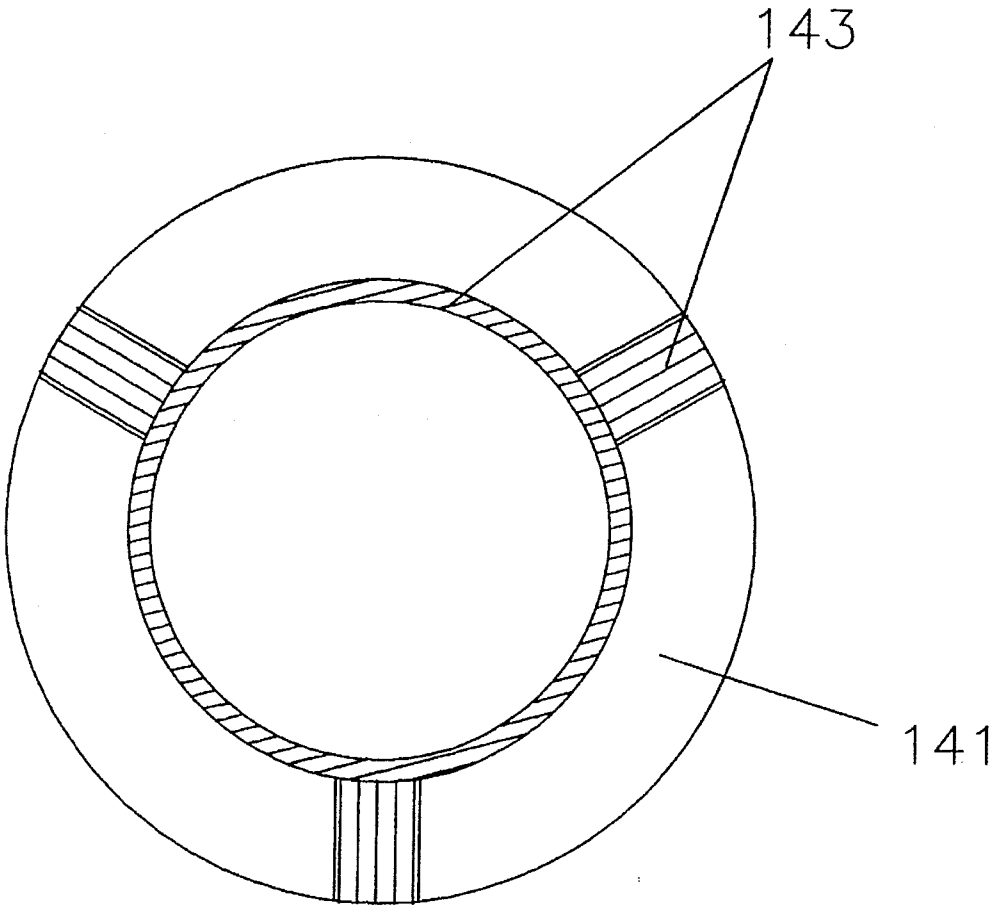
FIG. 6 shows details of a segmented shaft.

In FIG. 5, an embodiment of the flexible band-gear system is shown having multiple current/signal channels implemented in a single band layer. As an example, this being one of many possible arrangements, a segmented ring assembly 13' is divided into six conductive sections **13*a*' representing separate channels separated by electrical insulator sections and a corresponding number of planet gear assemblies 11' provides rolling electrical contact between each ring assembly section and a corresponding section of a segmented sun gear assembly 12' The sun gear assembly 12' is segmented in a similar manner to the ring gear assembly. Each sun gear assembly section is in electrical contact with a corresponding (axially extending) segment of a segmented shaft 14'** and is insulated from the other sun gear assembly sections and shaft sections. An electronic switching device may be used externally to separate signals from the shaft segments into their proper channels. As an alternative, the shaft can also be wired with electrically insulated wires to transfer the power/signal from the segmented sun gear assembly to a transmitting or receiving device. Thus, the current/signals can be transmitted on multiple, separate channels across the rotary joint.

in FIG. 6, an example of a segmented shaft is shown in detail for transferring signals in separate channels across a single band layer. In this example, the flexible band-gear assembly is configured to provide three signal channels, and the bands of the ring and sun gear assemblies are divided into three segments each. The segmented shaft is formed from three corresponding conductive shaft segments 141' mounted on an insulative shaft core 143' molded with insulative spacers for holding the conductive shaft segments 141' therein. The shaft segments extend in the axial direction and are circumferentially spaced from each other and are in fixed electrical contact with the corresponding band segments of the sun gear assembly.

Figure 7:
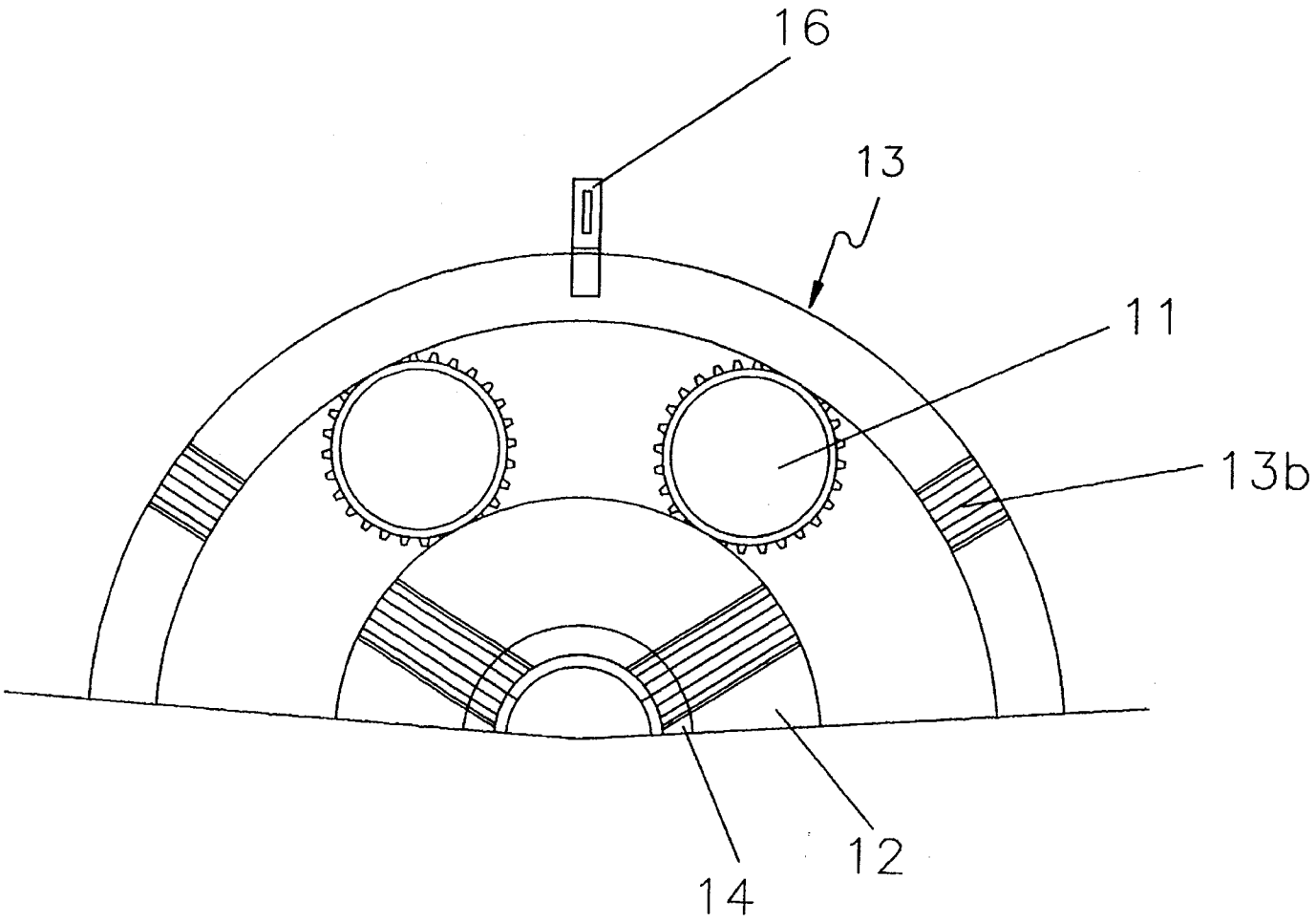
FIG. 7 shows details of a segmented ring assembly.

The current carrying capacity of each channel is dependent upon the number of planet gear assemblies in contact with each band section of the ring gear assembly. FIG. 7 shows an embodiment wherein multiple planet gear assemblies are provided within the annulus of the ring gear assembly to provide multiple channel paths for signal transfer in each channel. A position sensing/switching device can be used to ensure that the proper signals are transferred across each channel as the planet gears move in rotation.

Figure 8:
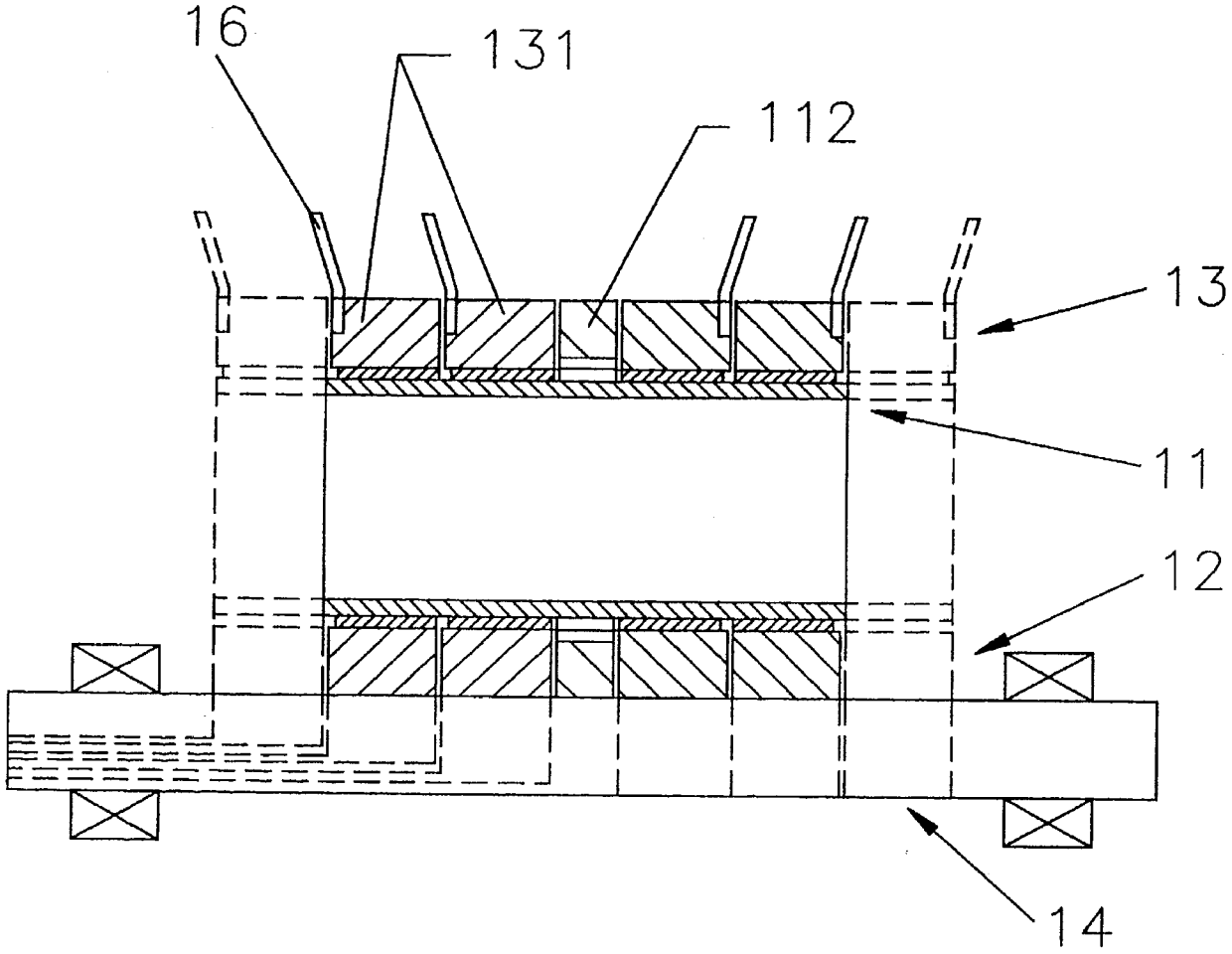
FIG. 8 is a half-sectional view of a further embodiment of a flexible band-gear assembly having multiple channel capability provided through multiple bands on the ring, planet and sun gears.

In FIG. 8 another embodiment of the flexible band-gear system is shown having multiple current/signal channels provided through multiple band layers. The multiple band layers are arranged in a stack formation (in the axial direction) on the planet, ring and sun gear assemblies 11", 13", and 12", respectively. The shaft 14" can also be provided (as indicated in phantom line) with band layers on an insulative core arranged in corresponding stack formation and in electrical contact with the band layers of the sun gear assembly to transfer the signals from the multiple band layers in multiple, separate channels. An electronic switching device can then be used to transfer signals from one or a combination of band layers and band channels on the shaft. Alternatively, the signals may be transferred by insulative wires extending from the bands of the sun gear assembly. The flexible band-gear system may further be implemented with multiple bands and multiple segments in each band to multiply the number of channels or to provide multiplexed signals within a given number of channels. The number of channels provided by the bands and/or segments is limited by the physical boundaries of the system.

Figure 9:
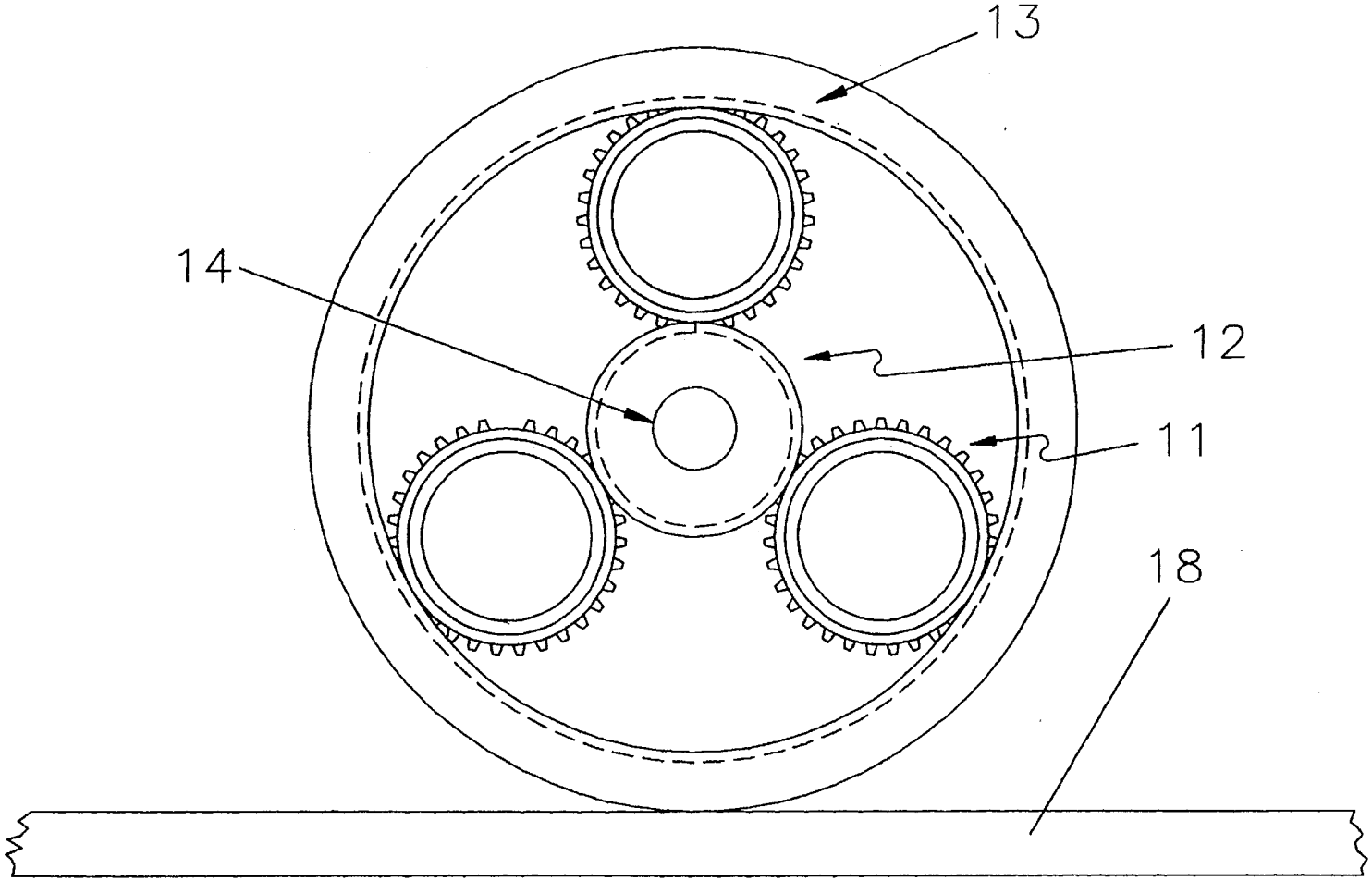
FIG. 9 illustrates an embodiment of a flexible band-gear assembly for transferring electrical power/signal and mechanical power across rolling contact with a linear moving member.

FIG. 9 shows an application of the flexible band-gear system where electrical power/signal is transferred through rolling contact with a linear member or band 18. In this instance, the flexible band-gear assembly is in a fixed position while the linear band 18 is translated in linear motion. An external band of the ring gear assembly is preloaded in electrical contact against the linear band, and current/signal is transferred across the bands of the ring, planet, and sun gear assemblies and the rotating shaft 14. The current conducting surfaces are designed to minimize slipping and maximize rolling band contact. The converse arrangement (fixed linear band and rolling band-gear system) may be used in systems where power/signal is transferred from a linear track to a moving device, for example, electric powered trains.

The flexible band-gear system may be optimized in specific manufacturing processes. The shaft 14 is manufactured from material that provides low wear and high rigidity. The shafts are first turned to a nominal diameter using bar stock material and are then polished to within a specified tolerance. Segmented shafts are manufactured from a solid base shaft pressed and keyed into a molded insulated sleeve. Extruded (conductive) segments are then cut to the desired length and inserted into the hollow sections of the molded sleeve. The gears are produced via standard spur gear manufacturing process using low wear material. The bearings may be standard off-the-shelf items. The electrical terminals may be standard terminal ends, UL rated for a desired power/signal output.

The bands are preferably manufactured as thin-walled cylindrical sections ranging in thickness from 0.025 inch to as much as 0.5 inch, depending upon the application. The bands may be produced from highly conductive cylindrical tubes with a specified wall thickness that are cut to specified band widths. The inside diameter of the bands are held to a tight tolerance to provide a mechanical press (interference) fit on the non-conductive cores of the planet gear assemblies. The cores are made from a non-conductive cylindrical tube with a specified wall thickness and flexibility and cut to the required width.

The degree to which the system of bands is preloaded is dependent on the particular application. A device designed for the transmission of power may require a higher preloading force than that designed for signals only. In either case, corresponding band deformations may range from 0.002 to 0.010 inches.

Beryllium copper (BeCu), with its strength, corrosion and wear resistance, conductivity, non-magnetic and non-sparking properties is a material that is ideally suited for the bands. Gold is another, more expensive material that may be used for the fabrication of the bands. The relatively low modulus of elasticity of BeCu (18 Mpsi) permits the design of highly flexible contact elements with almost the same conductivity of copper. It is possible to preload BeCu contact elements with higher forces than would be attainable with pure copper since the beryllium component of the alloy serves to increase the strength of copper. This allows the bands to have well defined and larger contact areas which are necessary for the low noise, high current capacity property of the device.

The flexible band-gear system of the invention may be used in a wide range of applications providing improvements over current technology in areas of increased reliability (reduced maintenance), increased service life, and cost reductions. From industrial to consumer product applications, this system can be used to replace conventional motors and driven parts employing brushes and slip rings. For example, in robotics the flexible band-gear system may be used for simplified, cableless robot wrist joints wherein rotary shaft input is used to control the angle of a robot hand mounted to the ring gear assembly and electrical power and/or control signals can be transmitted across the rotary joint to control the fingers of the robot hand. Machine tools can be equipped with sensor and other digitally controlled devices across the driven rotary joint to be located at the cutting interface. Oil well drilling head sensor systems can be implemented with brushless and radioless data transfer. Clean room manufacturing applicators and data transmission devices (across rotating shafts) can be made simpler and without particulate debris generation. Sensor systems for measuring torque across continuously rotating shafts can be achieved without slip rings or radio transmission systems.

In electrical power transmission, the flexible band-gear system can be applied to brushless electrical generators, brushless third rail systems for electric trains, electrified rotating signs and other moving structures. In aerospace applications, antenna and solar array mechanisms and motors used in space can be improved by using band-gears instead of slip rings.

In consumer products, the flexible band-gear system can be applied to a wide range of applications for brushless motors and motor driven systems, for example, household machines, automobile alternators, moving parts sensors, hand tools, etc. It can also be advantageously used in environments where a component or module is driven in linear or rotary motion while being used for a function under signal control, such as printheads, actuators, lens systems, recording/writing heads, etc.

Although the invention has been described with reference to certain preferred embodiments, it will be appreciated that many variations and modifications may be made consistent with the principles of the invention disclosed herein. It is intended that the preferred embodiments and all such variations and modifications be included within the scope and spirit of the invention, as defined in the following claims.

We claim:

1. A flexible band-gear system for transferring electrical power or an electrical signal across a rotary joint comprising:

a ring gear assembly including an annular ring gear centered on a main axis having gear teeth disposed on an inner annular surface facing toward the main axis, and at least one band centered on the main axis in proximate relation to said annular ring gear having an electrically conducting layer disposed on an inner annular surface thereof facing toward the main axis;

a plurality of planet gear assemblies disposed in spaced relation from each other inwardly of said ring gear assembly and spaced at equal radial distances from the main axis, wherein said planet gear assemblies each have a respective planet gear rotatable about an individual planet gear axis with gear teeth on an annular surface thereof in geared engagement with said ring gear of said annular ring gear assembly, and at least one band centered on the individual planet axis in proximate relation to said planet gear having an electrically conducting layer disposed on an outer annular surface thereof in rolling electrical contact with the band of said annular ring gear assembly; and a sun gear assembly disposed inwardly of said planet gear assemblies and centered on the main axis, said sun gear assembly including a sun gear provided with gear teeth facing outwardly in geared engagement with the planet gears of said planet gear assemblies, at least one band centered on the main axis in proximate relation to said sun gear member having an electrically conducting layer facing outwardly in rolling electrical contact with the bands of said planet gear assemblies, a rotary member aligned on the main axis mounting said sun gear and band, and conducting means in electrical contact with said band of said sun gear assembly for transferring electrical power or an electrical signal to or from an external device, whereby electrical power or an electrical signal can be transferred to or from the external device through said bands of said ring, planet, and sun gear assemblies in rolling electrical contact with each other across a rotary joint represented by said rotary member centered on the main axis within the flexible band-gear system.

2. A flexible band-gear system according to claim 1, wherein said sun gear and band form a sun gear assembly, and said rotary member is a rotary shaft to which said sun gear assembly is fixedly mounted.

3. A flexible band-gear system according to claim 2, wherein said band of said sun gear assembly is in electrical contact with said rotary shaft, and said rotary shaft is made of a conductive material and is used to transfer electrical power or an electrical signal to or from the rotary joint.

4. A flexible band-gear system according to claim 1, wherein said ring, planet, and sun gear assemblies each have two bands disposed in an axial direction on both sides of the respective proximate gear disposed in the center thereof.

5. A flexible band-gear system according to claim 1, wherein said ring gear assembly includes a terminal member in electrical contact with said at least one band for transferring electrical power or an electrical signal to or from the rotary joint.

6. A flexible band-gear system according to claim 1, wherein said ring gear assembly includes a pair of insulative members disposed on both external sides in the axial direction of said ring gear and at least one band.

7. A flexible band-gear system according to claim 1, wherein said individual planet gear assemblies have their respective bands and planet gears fixedly mounted on a core made of nonconductive material.

8. A flexible band-gear system according to claim 1, wherein the respective bands of said ring, planet, and sun gear assemblies are electrically insulated from their respective proximate gears which are made of conductive material, such that electrical power can be transferred across the rotary joint through the conductive gears in geared engagement with each other, and an electrical signal can be transferred separately from the electrical power across the rotary joint through the bands in rolling electrical contact with each other.

9. A flexible band-gear system according to claim 1, wherein said at least one band of said ring gear assembly and said at least one band of said sun gear assembly are each divided into an equal number of band segments which are electrically insulated and circumferentially spaced from each other and arranged in radial correspondence with the band segments of the other gear assembly, and said plurality of planet gear assemblies with individual bands in electrical contact between corresponding ones of the band segments of said ring gear assembly and said sun gear assembly allow electrical signals to be transferred on a plurality of separate conductive channels across the rotary joint.

10. A flexible band-gear system according to claim 9, wherein said plurality of planet gear assemblies are in number equal to the number of band segments in each of said ring and sun gear assemblies.

11. A flexible band-gear system according to claim 9, wherein said plurality of planet gear assemblies are in number equal to a multiple of the number of band segments in each of said ring and sun gear assemblies, so as to provide multiple conductive channel paths between corresponding ones of the band segments in each of said ring and sun gear assemblies.

12. A flexible band-gear system according to claim 9, wherein said sun gear and band form a sun gear assembly, and said rotary member is a rotary shaft to which said sun gear assembly is fixedly mounted.

13. A flexible band-gear system according to claim 12, wherein said shaft is formed with a plurality of conductive shaft segments mounted on an insulative shaft core extending in the axial direction, said conductive shaft segments being circumferentially spaced from each other and being equal in number to and in fixed electrical contact with the corresponding band segments of said sun gear assembly.

14. A flexible band-gear system according to claim wherein said ring gear assembly, said planet gear assemblies, and said sun gear assembly each have a plurality of band layers equal in number to each other which are electrically insulated from each other and spaced in a stacked formation in axial correspondence with the band layers of the other gear assemblies to allow electrical signals to be transferred on a plurality of separate conductive channels across the rotary joint.

15. A flexible band-gear system according to claim wherein said sun gear and band form a sun gear assembly, and said rotary member is a rotary shaft to which said sun gear assembly is fixedly mounted.

16. A flexible band-gear system according to claim 15, wherein said shaft is formed with a plurality of conductive shaft band layers mounted on an insulative shaft core equal in number to and spaced in the stacked formation in axial correspondence with the band layers of said sun gear assembly.

17. A flexible band-gear system according to claim 1, wherein the band of said ring ,gear assembly has an annular conductive surface which is placed in rolling electrical contact with a conductive linear member to allow electrical power or an electrical signal to be transferred to or from the conductive linear member across the rotary joint.

18. A flexible band-gear system according to claim 17, wherein said ring gear assembly is in a fixed linear position and the linear member is translated in linear motion.

19. A flexible band-gear system according to claim 17, wherein the linear member is in a fixed linear position and said ring gear assembly is translated in rolling motion relative to the linear member.

20. A flexible band-gear system according to claim 1, wherein said rotary member is a mechanical input member for the rotary joint.

* * * * *